US006951276B2

(12) United States Patent
Danner et al.

(10) Patent No.: US 6,951,276 B2
(45) Date of Patent: Oct. 4, 2005

(54) PACK FOR PROCESSING CHEMICALS

(75) Inventors: Hans-Dieter Danner, Leichlingen (DE); Detlef Ehrenberg, Vaihingen (DE); Wilfried Hehn, Müenchen (DE); Stefan Huber, Munich (DE); Ralf Wichmann, Bergisch-Gladbach (DE); Bernd Zeier, Köln (DE)

(73) Assignee: AgfaPhoto GmbH (DE)

( * ) Notice: Subject to any disclaimer, the term of this patent is extended or adjusted under 35 U.S.C. 154(b) by 111 days.

(21) Appl. No.: 10/114,389

(22) Filed: Apr. 1, 2002

(65) Prior Publication Data

US 2002/0117416 A1 Aug. 29, 2002

Related U.S. Application Data

(63) Continuation-in-part of application No. 09/589,921, filed on Jun. 7, 2000, now abandoned.

(30) Foreign Application Priority Data

Jun. 9, 1999 (DE) ..... 199 26 176

(51) Int. Cl.[7] ..... B65D 85/00
(52) U.S. Cl. ..... 206/229; 206/526; 220/23.88
(58) Field of Search ..... 396/564; 141/234, 141/285, 363–366; 206/216, 219, 223, 229, 526, 527; 220/23.83, 23.86, 23.87, 23.88

(56) References Cited

U.S. PATENT DOCUMENTS

| | | | | |
|---|---|---|---|---|
| 207,360 A | * | 8/1878 | Litzelle | 312/209 |
| 4,103,358 A | | 7/1978 | Gacki et al. | |
| 4,271,965 A | | 6/1981 | Brambley et al. | |
| 4,941,131 A | * | 7/1990 | Daly et al. | 366/173.1 |
| 5,543,884 A | * | 8/1996 | Earle et al. | 396/626 |
| 5,577,614 A | * | 11/1996 | Palmeroni et al. | 206/521 |
| 5,765,071 A | | 6/1998 | Kinoshita et al. | |
| 5,930,550 A | | 7/1999 | Tanaka | |
| 5,996,653 A | | 12/1999 | Piccinino, Jr. | |
| 6,457,602 B2 | | 10/2002 | Uchiyama | |
| 2002/0142253 A1 | * | 10/2002 | Call et al. | 430/461 |

FOREIGN PATENT DOCUMENTS

| | | |
|---|---|---|
| DE | 91 02 722.5 | 7/1991 |
| EP | 0 271 610 | 5/1988 |
| EP | 0 424 820 | 5/1991 |
| EP | 0 668 537 B1 | 8/1995 |

OTHER PUBLICATIONS

New Kodak Ektacolor SM and Flexicolor SM Chemicals for SM Minilabs; 1996.

* cited by examiner

*Primary Examiner*—Jim Foster
(74) *Attorney, Agent, or Firm*—Connolly Bove Lodge & Hutz LLP

(57) ABSTRACT

A pack for concentrates of a plurality of photographic processing chemicals comprising a carton of standard height, width and depth, in which at least two chemicals bottles are disposed alongside one another, with their outlet openings situated at the same height (viewed from the carton base) and a predetermined distance apart from one another, wherein one carton side comprises features which permit a smooth mounting onto a specially provided surface of the processing unit and docking to the processing unit in one way only, allows almost automatic replenishing of the photographic processing solutions in the processing unit in combination with easiest handling.

6 Claims, 1 Drawing Sheet

PACK FOR PROCESSING CHEMICALS

CROSS REFERENCE TO RELATED APPLICATION

The present application is a continuation-in-part of application Ser. No. 09/589,921 filed Jun. 7, 2000 now abandoned.

The invention relates to a pack of concentrates of photographic processing chemicals.

In the following, the terms "top" and "bottom" are used in the manner in which they arise in a bottle standing upright on its base.

Bottles for storing photographic processing chemicals are required to meet a range of standards:

- they have to be hermetically sealed even when suspended with the outlet directed downwards.
- they have to be dockable to a processing unit
- they have to be able to open automatically and empty easily and completely.

These bottles which are filled with concentrated solutions of photographic processing chemicals, which are later diluted with water in the processing unit to produce the actual processing solutions, are introduced in particular as a multi-pack into a processing unit because, for processing a colour negative film up to the finished paper print, a series of processing baths are run through, which have to contain the correct chemicals in the correct concentration, e.g.:

- film developing bath
- film bleaching bath
- film fixing bath
- film stabilizing bath
- paper developing bath
- paper bleach-fixing bath
- paper stabilizing bath Said baths are prepared from concentrates through dilution with water and are each regenerated in accordance with consumption (number of films developed and/or area of developed paper). Thus, a number of different concentrates have to be introduced at the correct point into the processing unit. Said number is additionally increased by the fact that for specific baths a plurality of concentrates of differing composition are required because not all of the chemicals situated therein are stable when blended with one another. Thus, for example, the film developer is mixed from three different fractions, the paper bleach-fixing bath is mixed from two different fractions and, occasionally, the correct order of addition has to be observed.

BRIEF DESCRIPTION OF THE DRAWINGS

Novel features and advantages of the present invention in addition to those mentioned above will become apparent to persons of ordinary skill in the art from a reading of the following detailed description in conjunction with the accompanying drawings wherein similar reference characters refer to similar parts and in which.

DETAILED DESCRIPTION OF THE INVENTION

Figure 1:
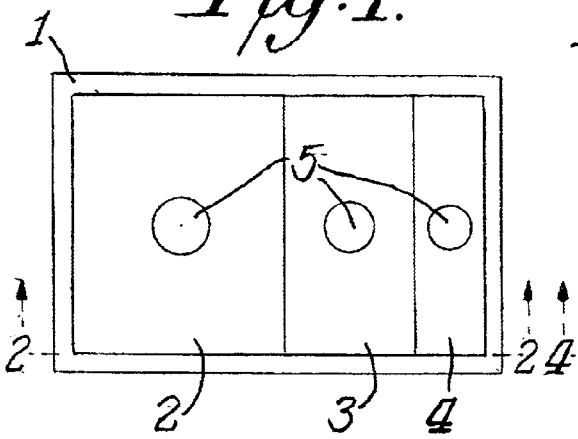
FIG. 1 is a top plan view of a pack containing three bottles having the same height but with different volumes and cross-sections.
Figure 2:
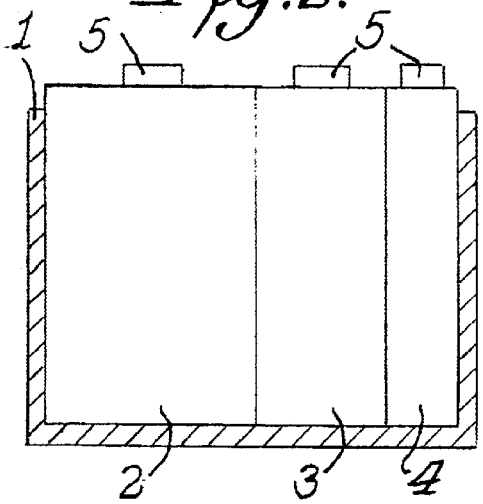
FIG. 2 is a cross-sectional view in elevation taken along line 2-2 of FIG. 1.

Referring in more particularity to the drawings, FIGS. 1 and 2 illustrate a carton or pack containing bottles 2, 3 and 4 each with a closure 5. Each bottle has the same height but different volumes and cross-sections, as shown.

Figure 3:
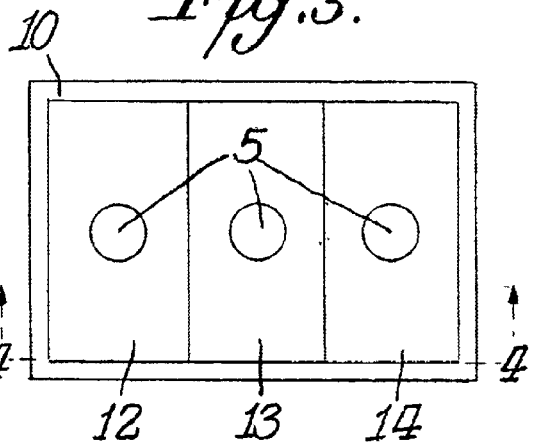
FIG. 3 is a top plan view of a pack containing three bottles having different heights and volumes but with identical cross sections.
Figure 4:
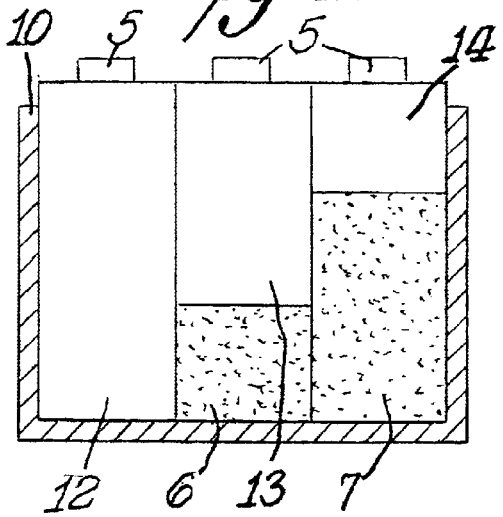
FIG. 4 is a cross-sectional view in elevation taken along line 4—4 of FIG. 3.

FIGS. 3 and 4 illustrate a carton or pack 10 containing bottles 12, 13 and 14 each with a closure 5. Each bottle has the same cross-section but with different heights and volumes. Raised base portions 6 and 7 are provided inside the carton. Bottle 13 stands on base portion 6 while bottle 14 stands on base portion 7. The height of the base portions 6, 7 is selected so that the effective height of each bottle in the carbon is the same.

Therefore according to the invention one pack for a plurality of processing chemicals is provided, which comprises a carton of standard height, width and depth, in which at least two chemicals bottles are disposed alongside one another, with their outlet openings situated at the same height (viewed from the carton base) and a predetermined distance apart from one another, wherein one carton side comprises features which permit a smooth mounting onto a specially provided surface of the processing unit in one way only.

Preferable, separate packs are provided for film processing and for paper processing.

As different quantities of the various concentrates are usually required for processing a specific length of film or area of paper, the chemicals bottles are preferably of differing sizes. For the arrangement of the bottles in the carton of plurality of solutions are available: e.g. bottles of identical height but differing cross section or bottles of identical cross section but differing height, wherein the height difference is compensated by means of bases, which are situated in the carton and on which the smaller bottles stand.

The bottles are preferably rectangular in cross section as, by said means, the greatest packing density and hence the smallest possible carton is achievable for a preset volume.

In line with the carton size, the processing unit comprises a mounting surface, onto which the carton is placed. The mounting surface is produced, for example, by folding a vertical outer wall of the unit outwards through 90°, thereby obtaining, on the one hand, the required opening of the unit and, on the other hand, the required mounting surface for the pack. The mounting surface is designed in such a way that the pack with the lid or with the opening at the side may occupy only one of the four possible positions, e.g. by virtue of the fact that length and width of the mounting surface differ and the mounting surface is delimited by edges which project upwards in the open state of the unit. The, in terms of height and width, likewise differing pack, wherein height and width of the pack correspond with length and width of the mounting surface, may then occupy only two of the four possible positions. To guarantee determinate mounting, an asymmetrically fitted rib is provided e.g. on the mounting surface and corresponds with a groove in the pack side.

By said measures the effect is reliably achieved that the pack may be mounted precisely onto the mounting surface and then introduced into the unit only if mounted in the correct manner.

The lid of the pack is removed, unless the pack is in any case open at the top, to enable docking of the concentrate in the unit. To said end, the lid is so designed that it may be removed as far as possible without aids, easily and always at the same height e.g. by virtue of the fact that it is designed as a slip lid or is separated from the carton by means of a circumferential tear-off thread.

The pack is preferably designed is such a way that the bottle necks project beyond the top edge of the carton in the open state.

During introduction of the open pack into the processing unit, the bottle necks of the still closed chemicals bottles are centred and arrested by means provided on the unit, e.g. gripping forks. This enables accurately fitting docking of all the bottles contained in the carton.

The pack is then rotated through 90°, the bottles are opened at the desired moment and their contents run into the regenerating tanks, from which after dilution with water the processing tanks are fed.

Opening of the concentrate bottles may, where necessary, also be effected successively.

What is claimed is:

1. A pack of concentrates of a plurality of photographic processing chemicals comprising a carton in which at least two bottles containing photographic processing chemicals are disposed alongside one another within the carton, the bottles having outlet openings situated at the same height relative to a base of the carton and a predetermined distance apart from one another, and wherein the pack comprises bottles of different sizes, the bottles being of identical height, but of differing cross section.

2. A pack according to claim 1, wherein each bottle has a rectangular cross section.

3. A pack according to claim 1, wherein the carton is open on top to allow docking to a processing unit.

4. A pack according to claim 3, wherein each bottle has a neck that projects beyond a top edge of the carton.

5. A pack according to claim 1, wherein the height and the width of the pack are different from each other.

6. A pack according to claim 1, wherein the photographic processing chemicals are selected from the group consisting of paper developing bath, paper bleach-fixing bath and paper stabilizing bath, and wherein the paper bleach-fixing bath comprises two different fractions.

* * * * *